US009038491B2

(12) United States Patent
Burton et al.

(10) Patent No.: US 9,038,491 B2
(45) Date of Patent: May 26, 2015

(54) METHOD OF REPOSITIONING BEARING WEAR IN AN INDUSTRIAL ECCENTRIC WEIGHT VIBRATOR VIA POWER INVERSION AND VIBRATOR THEREFORE

(71) Applicant: Martin Engineering Company, Neponset, IL (US)

(72) Inventors: Grant S. Burton, Dunlap, IL (US); Travis J. Miller, Annawan, IL (US)

(73) Assignee: Martin Engineering Company, Neponset, IL (US)

( * ) Notice: Subject to any disclaimer, the term of this patent is extended or adjusted under 35 U.S.C. 154(b) by 275 days.

(21) Appl. No.: 13/888,043

(22) Filed: May 6, 2013

(65) Prior Publication Data

US 2014/0326088 A1 Nov. 6, 2014

(51) Int. Cl.
*B06B 1/16* (2006.01)

(52) U.S. Cl.
CPC ..... *B06B 1/161* (2013.01); *Y10T 74/18552* (2015.01)

(58) Field of Classification Search
CPC .... B06B 1/161; B06B 1/162; Y10T 74/18344
USPC ..... 74/87, 61
See application file for complete search history.

(56) References Cited

U.S. PATENT DOCUMENTS

| | | | | | |
|---|---|---|---|---|---|
| 3,145,831 | A * | 8/1964 | Roder et al. | 198/753 |
| 3,396,805 | A * | 8/1968 | Muller | 173/49 |
| 3,505,885 | A * | 4/1970 | Waschulewski et al. | 74/61 |
| 4,040,303 | A | 8/1977 | Makino | |
| 4,211,121 | A | 7/1980 | Brown | |
| 4,262,549 | A * | 4/1981 | Schwellenbach | 74/87 |
| 2009/0241704 | A1 * | 10/2009 | Heichel et al. | 74/61 |
| 2011/0067510 | A1 * | 3/2011 | Peng | 74/87 |
| 2011/0290048 | A1 * | 12/2011 | Stein et al. | 74/61 |
| 2013/0283941 | A1 * | 10/2013 | Burton | 74/87 |
| 2014/0305236 | A1 * | 10/2014 | Kleibl et al. | 74/61 |

* cited by examiner

*Primary Examiner* — William Kelleher
*Assistant Examiner* — Valentin Craciun
(74) *Attorney, Agent, or Firm* — Thompson Coburn LLP; Clyde L. Smith

(57) ABSTRACT

A vibratory device comprises a rotor and an eccentric weight. The eccentric weight is mounted to the shaft and has a center of mass that is offset from the shaft axis. The vibratory device is configured such that the eccentric weight is in a first rotational orientation relative to the shaft and rotates with the shaft when the shaft rotates in a first direction about the shaft axis and such that the eccentric weight is in a second rotational orientation relative to the shaft when the shaft rotates in an opposite second direction about the shaft axis. The vibratory device is further configured such that the eccentric weight automatically transitions from the first rotational orientation to the second rotational orientation when the shaft is switched from rotating in the first direction to rotating in the second direction.

15 Claims, 6 Drawing Sheets

METHOD OF REPOSITIONING BEARING WEAR IN AN INDUSTRIAL ECCENTRIC WEIGHT VIBRATOR VIA POWER INVERSION AND VIBRATOR THEREFORE

CROSS-REFERENCE TO RELATED APPLICATIONS

Not Applicable

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to industrial vibrators of the type used in the bulk material handling industry, as well as other industries. More particularly, this invention pertains to a rotary industrial vibrator device having repositionable eccentric weights and to methods for extending the useful life of such rotary vibratory devices. The eccentric weights can be repositioned relative to the rotor shaft simply by inverting or shifting the phase or voltage of the power supplied to the vibrator. Repositioning the weights changes the location of maximum bearing wear and thereby extends the life of the vibrator.

2. General Background

Industrial vibrators are used throughout the bulk material handling industry for various purposes. Such industrial vibrators are often attached to bulk material transfer chutes and bulk material storage hoppers to prevent bulk material from clinging to the walls of such chutes and hoppers. Industrial vibrators are also utilized on sifting screens to prevent larger material from clogging the sifting screens and to speed the flow of material passing through the screens.

A common type of vibratory device is the rotary vibratory motor, wherein eccentric weights are rotationally driven by, and rotate about, a shaft axis via an electric motor to thereby generate oscillating forces. Other types of vibratory devices include, but are not limited to, acoustical vibration devices, air driven rotary vibrators, and linear vibrators. The present invention pertains specifically to electric driven eccentric weight vibrators.

In rotatory vibratory devices, the forces generating in by the rotating eccentric weights are transmitted to the motor housing via the bearings that support the rotor shaft. In view of the eccentricity of the weights, the bearing forces acting on the rotary shaft peak on the side of the bearing shaft that is closest to the center of mass of the eccentric weights, while the opposite side of the rotor shaft sees little, if any, bearing load. As a result, the portion of the bearing surface of the shaft closest to the center of mass of the eccentric weights wears at the greatest rate.

SUMMARY OF THE INVENTION

The inventors of the present invention have appreciated that the useful life of rotary vibratory devices can be extended by periodically altering the location of greatest bearing surface wear rate circumferentially about the rotor shaft. The inventors have also developed rotary vibratory devices that are configured and adapted to allow for periodically altering the location of greatest bearing surface wear rate with minimal effort.

In one aspect of the invention, a vibratory device comprises a rotor and a first eccentric weight. The rotor has a shaft and a rotation limiter. The shaft has a shaft axis about which the rotor is configured to rotate. The first eccentric weight is pivotally mounted to the shaft and has a center of mass that is offset from the shaft axis. The first eccentric weight comprises a rotation limiter that cooperates with the rotation limiter of the rotor in a manner such that the eccentric weight is able to pivot about the shaft axis relative to the shaft only through an arc of rotation that is less than 360 degrees. As such, the rotor can rotationally drive the eccentric weight around the shaft axis and the weight is able to pivot through an arc about the shaft axis when the rotational direction of the rotor is flipped. Thus, the location of greatest bearing surface wear rate can be circumferentially relocated about the shaft by simply flipping the rotational direction of the rotor.

In another aspect of the invention, a vibratory device comprises a rotor and an eccentric weight. The rotor has a shaft and the shaft has a shaft axis about which the rotor is configured to rotate. The eccentric weight is mounted to the shaft and has a center of mass that is offset from the shaft axis. The vibratory device is configured such that the eccentric weight is in a first rotational orientation relative to the shaft and rotates with the shaft when the shaft rotates in a first direction about the shaft axis and such that the eccentric weight is in a second rotational orientation relative to the shaft when the shaft rotates in an opposite second direction about the shaft axis. The vibratory device is further configured such that the eccentric weight automatically transitions from the first rotational orientation to the second rotational orientation when the shaft is switched from rotating in the first direction to rotating in the second direction.

Yet another aspect of the invention pertains to a method of adjusting a vibratory device. The vibratory device comprises a rotor and an eccentric weight. The rotor has a shaft having a shaft axis about which the rotor is configured to rotate. The eccentric weight is mounted to the shaft and has a center of mass that is offset from the shaft axis. The vibratory device is configured such that the eccentric weight is in a first rotational orientation relative to the shaft and rotates with the shaft when the shaft rotates in a first direction about the shaft axis and such that the eccentric weight is in a second rotational orientation relative to the shaft when the shaft rotates in an opposite second direction about the shaft axis. The method comprises reversing the direction in which the shaft of the rotor and the eccentric weight rotate about the shaft axis in a manner causing the eccentric weight to move from the first rotational orientation to the second rotational orientation Further features and advantages of the present invention, as well as the operation of the invention, are described in detail below with reference to the accompanying drawings.

Figure 1:
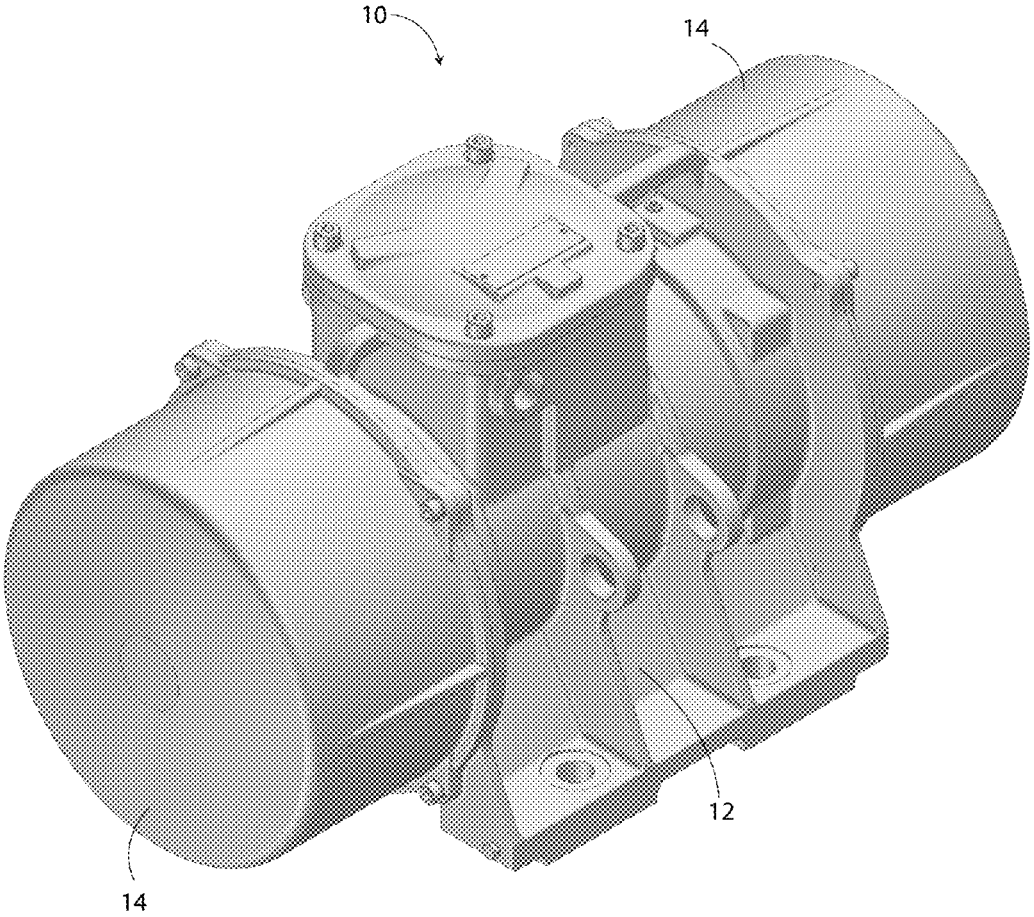
FIG. 1 depicts a perspective view of a rotary vibratory device.

Reference numerals in the written specification and in the drawing figures indicate corresponding items.

DETAILED DESCRIPTION

A preferred embodiment of an industrial eccentric weight vibrator in accordance with the present invention is shown in FIG. 1. The vibrator 10 comprises an outer housing 12 having removable end caps 14. Internally, the vibratory device 10 comprises a rotor 16 having a shaft 18. A plurality of eccentric weights 20 are mounted on the shaft 18 of the rotor 16 for rotation therewith.

Although some rotary vibratory devices may include only one eccentric weight or have eccentric weights only on one end of rotor shaft, the preferred embodiment of a rotary vibratory device 10 in accordance with the present invention comprises at least one eccentric weight 20 at each of the opposite end portions 22 of the rotor's shaft 18. Preferably the weights 20 are balanced such that the forces acting on each end portion of the shaft 18 equal each other and act in the same direction.

As is shown in FIGS. 3-6, the rotor 16 comprises an armature 24 that is centrally positioned on the shaft 18. The rotor 16 also comprises a plurality of bearings 26 that attach the rotor to the housing 12 for rotation (and transmit the vibrational forces to the housing). One or more bushings 28 are mounted to each of the opposite end portions 22 of the shaft 18. One of the bushings 28 comprises a rotation limiter 30 and one or more keyways 32. The rotation limiter 30 is preferably a protrusion that extends radially outward and away from the shaft 18. The shaft 18 also preferably comprises one or more keyways 34. One of the eccentric weights 20 on each end of the shaft 18 comprises a rotation limiter 36 that is configured to cooperate with the rotation limiter 30 of the bushing 28. The rotation limiter 36 of the eccentric weight 20 is preferably an arcuate groove or channel that permits the eccentric weight to pivot partially around the bushing 28 through an arc of only approximately one-hundred and eighty degrees. The eccentric weight 20 also preferably comprises one or more threaded locking holes 38 that allows a second eccentric weight 40 to be rotationally linked to the primary eccentric weight 20. A locking collar 42 is preferably mounted to the shaft 18 of the rotor 16 to axially trap the bushings 28 and weights 20, 40.

Figure 6:
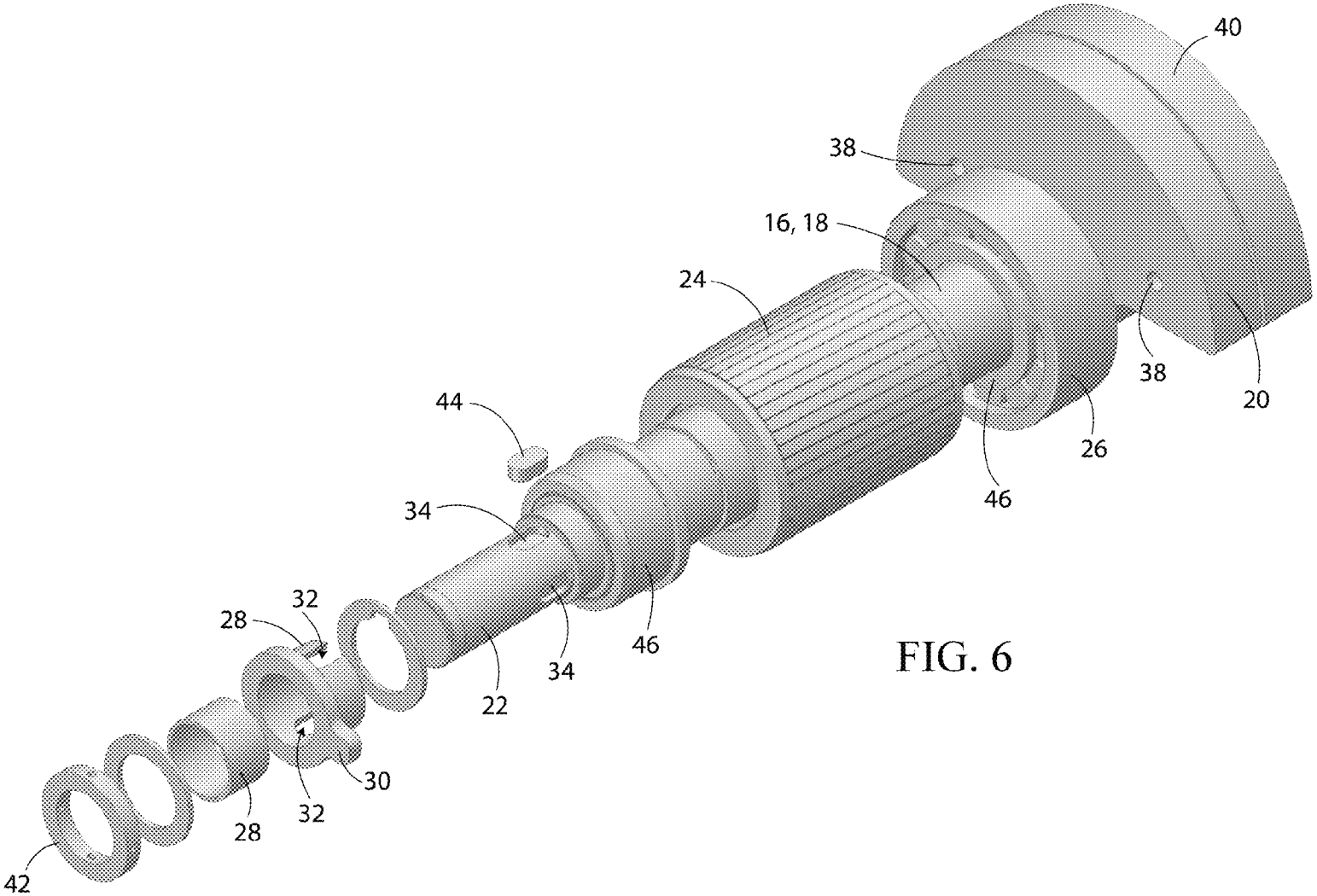
FIG. 6 depicts an exploded perspective view of some of the components of the vibratory device.

As shown in FIG. 6, one of the keyways 32 of the bushing 28 having the rotation limiter 30 is preferably locked in rotation with the shaft 18 of the rotor 16 via a key 44 that is positioned in the keyway 32 of the bushing and in one of the keyways 34 of the shaft. Thus the bushing 28 with the rotation limiter 30 is rotationally locked to the shaft 18, but can be rotationally repositioned by switching the alignment of the keyways 32, 34. As such, the rotation limiter 30 is also rotationally locked to the shaft 18 of the rotor 16. The rotation limiter 30 of the rotor 16 cooperates with the rotation limiter 36 of the primary eccentric weight 20 in a manner such that the eccentric weight is free to pivot about the shaft 18 of the rotor through an arc of, preferably, one-hundred and eighty degrees. The second eccentric weight 40 is mounted to one of the bushings 28 and is rotationally locked with the primary eccentric weight 20 via a bolt 48 threaded into one of the locking holes 38 of the primary weight 20. Thus, both weights 20, 40 are able to pivot about the shaft 18 of the rotor 16 through an arc of only one-hundred and eighty degrees.

Figure 2:
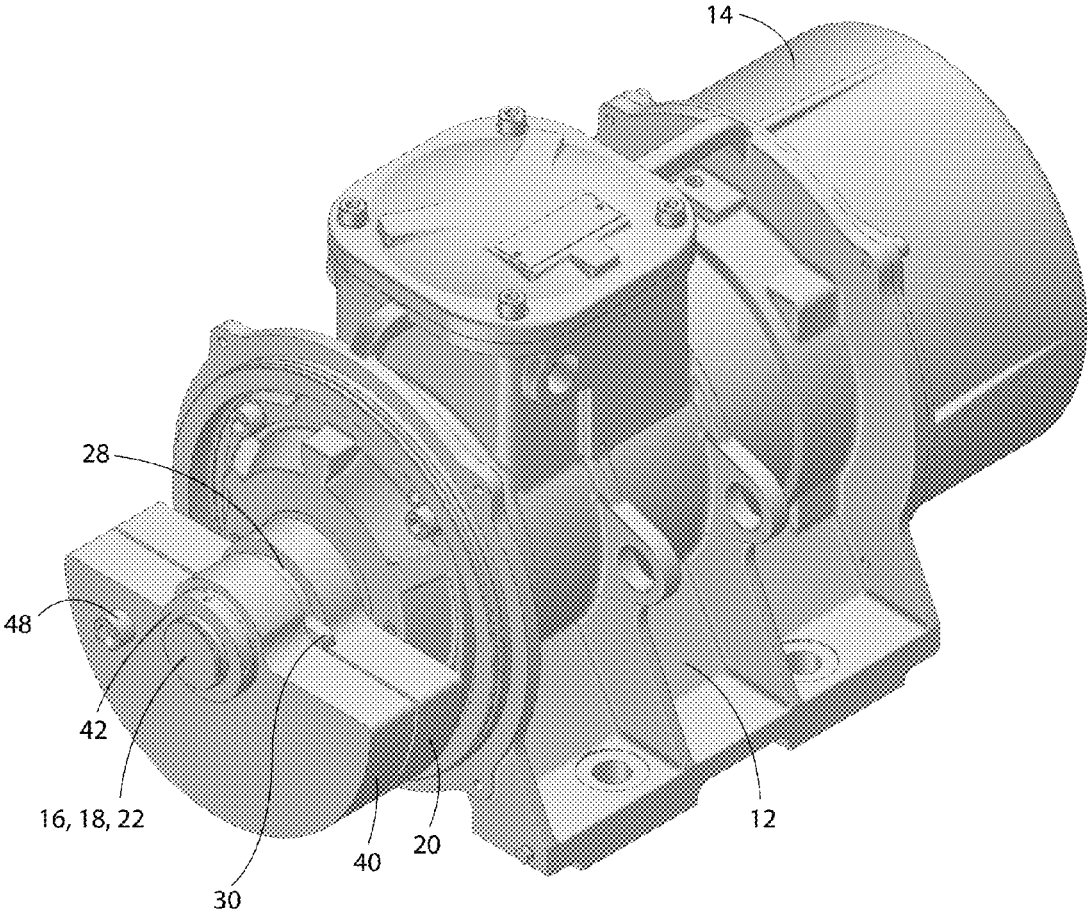
FIG. 2 depicts a perspective view of the vibratory device of FIG. 1, with one of its end caps removed to show the eccentric weights and rotor.
Figure 3:
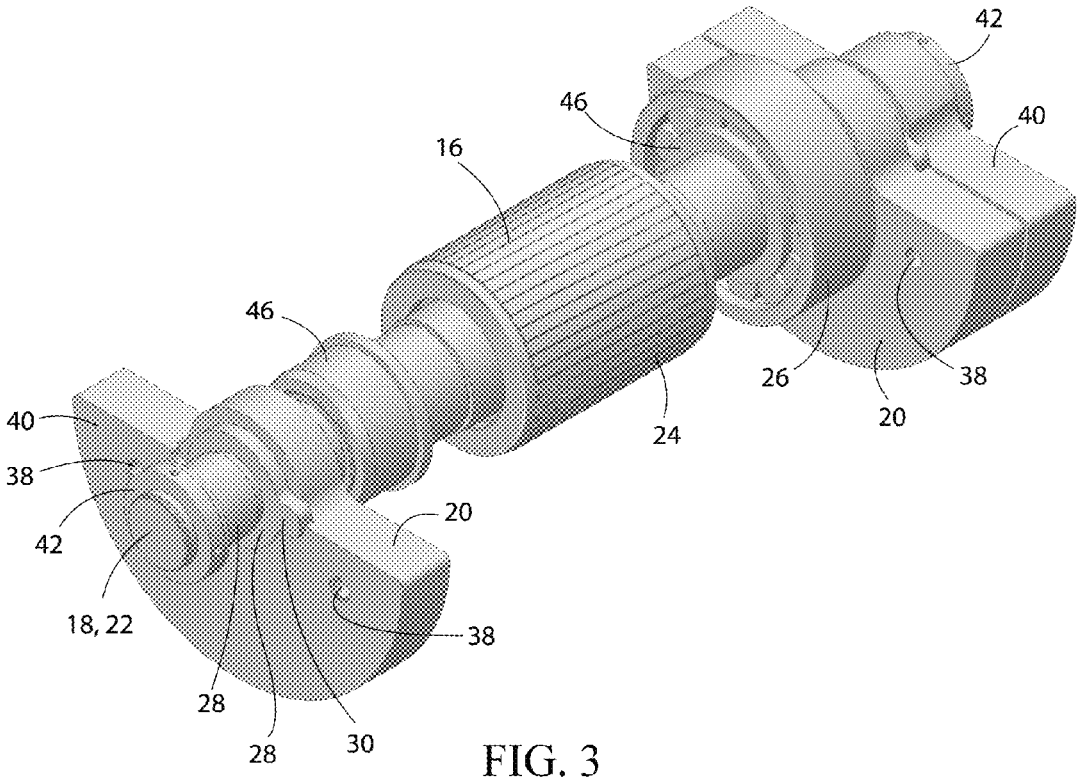
FIG. 3 depicts a perspective view of a partial assembly of the vibratory device.
Figure 4:
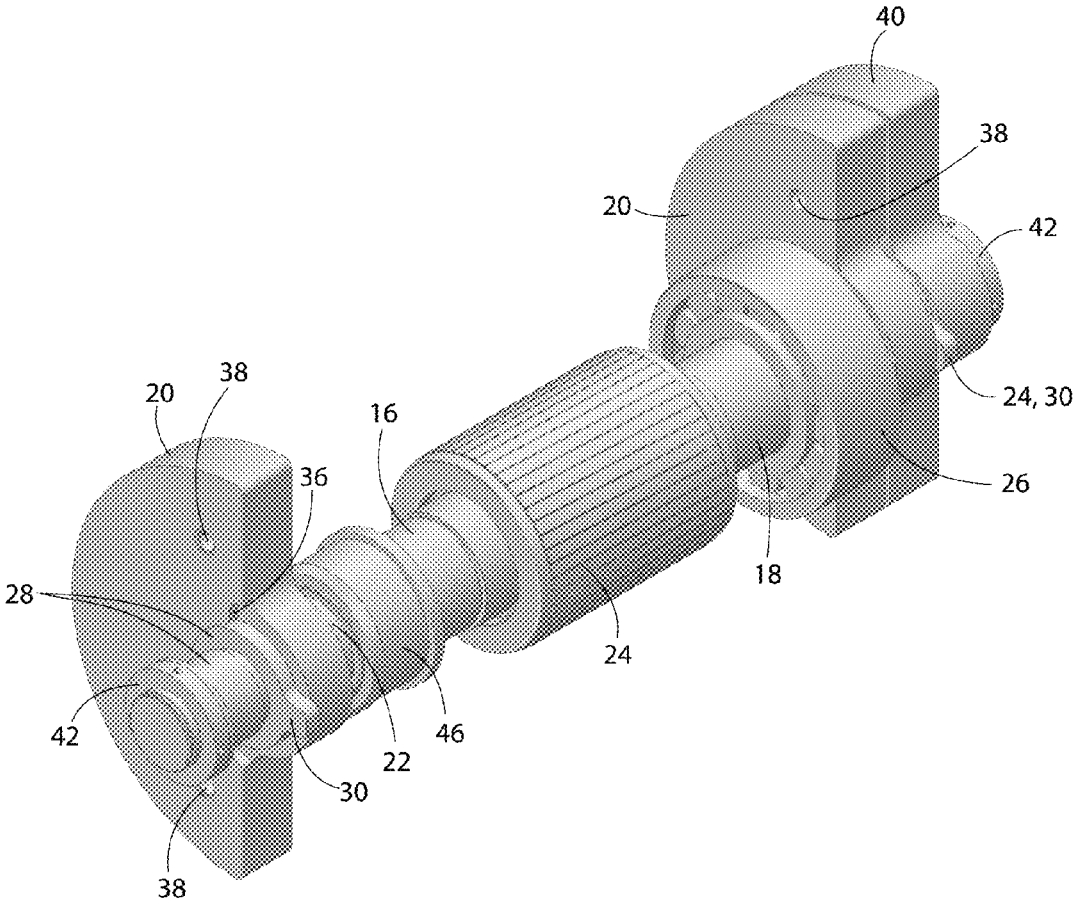
FIG. 4 depicts another perspective view of the partial assembly of the vibratory device with the eccentric weights in an intermediate position.
Figure 5:
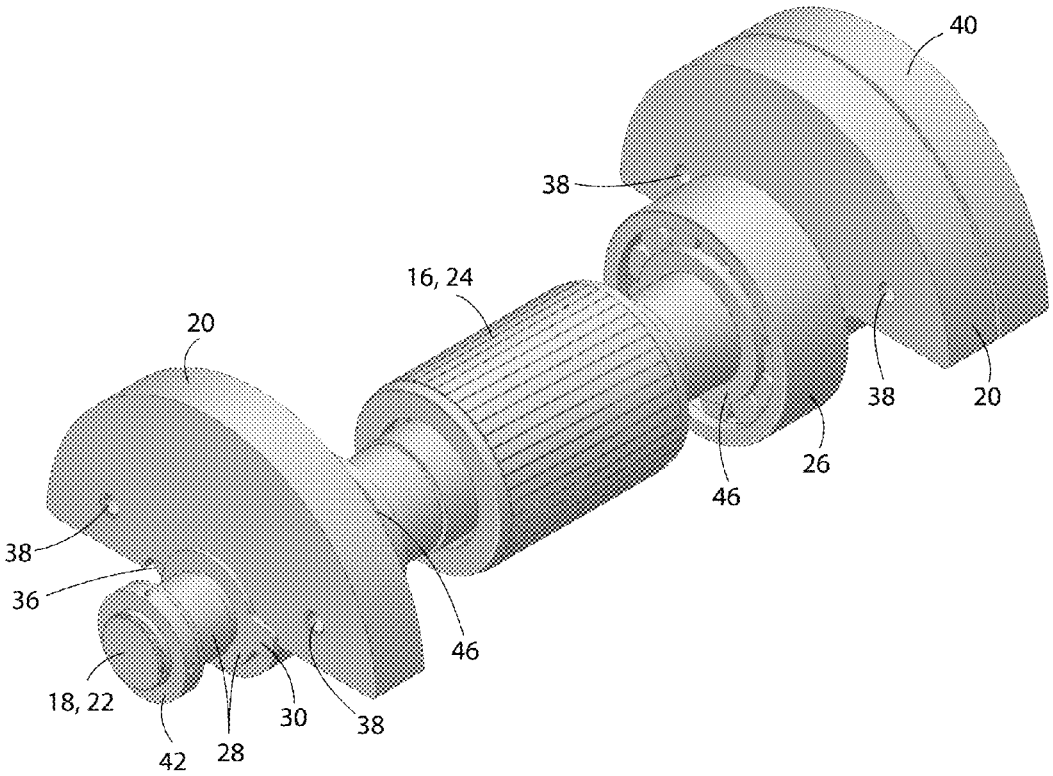
FIG. 5 depicts yet another perspective view of the partial assembly of the vibratory device with the eccentric weights in a reversed position.

When the industrial vibrator 10 is operated, the rotor 16 rotates in a particular direction. FIGS. 2 and 3 depict the vibrator 10 in its configuration when the shaft 18 of the rotor 16 rotates clockwise (as viewed). The cooperation between the rotation limiter 30 of the rotor 16 and the rotation limiter 36 of the primary eccentric weight 20 causes the rotor to rotationally drive the weights 20, 40 about the axis of the rotor's shaft 18. Due to the eccentric nature of the weights 20, 40, an oscillating radial load is generated and transmitted to the housing 12 of the vibrator 10 through the bearings 26 of the vibrator. It should be appreciated that the side of the inner race 46 of the bearing 26 to which the eccentric weights 20, 40 are offset carries the majority of the radial loads. Thus, over time, that portion of the inner race 46 wears at a greater rate than other portions of the bearing race. However, when that portion of the inner race 46 is fully worn, the radial load can be shifted to the opposite side of the inner race by switching the direction of rotation of the rotor 16. Switching the direction of the rotation of the rotor 16 can be achieved simply by inverting the phase and/or the polarity of the power that drives the vibrator 10. Due to the limited pivotal connection between the weights 20, 40 and the shaft 18 of the rotor 16, the weights then pivot one-hundred and eighty degrees relative to the shaft after the power has flipped. As shown in FIG. 5, the rotation limiter 30 of the bushing 28 then cooperates with the rotation limiter 36 of the primary weight 20 to drive the weights counterclockwise. Thus, the opposite side of the inner race 46 of the bearing 26 will then carry the radial loads generated by the eccentric weights 20, 40. This doubles the time that the vibrator can operate before the bearings 26 must be replaced. Moreover, the vibrator 10 does not need to be disassembled to switch the primary bearing location. If desired however, the end caps 14 of the vibrator 10 can be removed and the primary bearings can be rotationally repositioned on the shaft 18 of the rotor 16 by rotationally indexing the keys 32, 34 of the device. Thus, by providing keyways 32, 34 such that the bushing 28 can be repositioned ninety degrees relative to the shaft, the location of the maximum load on the inner race can be shifted at least three times (twice via power inversion and once via keyway repositioning).

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. An electrically powered vibratory device configured to generate an oscillating load, the vibratory device comprising:

a rotor having a shaft and a rotation limiter, the shaft having a shaft axis about which the rotor is configured to rotate;

a first eccentric weight pivotally mounted to the shaft, the first eccentric weight having a center of mass that is offset from the shaft axis, the first eccentric weight comprising a rotation limiter that cooperates with the rotation limiter of the rotor in a manner such that the first eccentric weight is able to pivot about the shaft axis relative to the shaft only through an arc of rotation that is less than 360 degrees;

the vibratory device being adapted and configured such that that the shaft, together with the first eccentric weight, can be rotationally driven about the shaft axis in opposite directions by switching the polarity of electrical power supplied to the vibratory device and such that the first eccentric weight will pivot through the arc in response to the polarity of electrical power being switch, the vibratory device being further adapted and configured such that switching the polarity of electrical power supplied to the vibratory device will not alter the oscillating load generated by the vibratory device.

2. A vibratory device in accordance with claim 1 wherein the rotor comprises bushing, the bushing comprises the rotation limiter, and the first eccentric weight is mounted on the bushing and is pivotal through the arc relative to the shaft.

3. A vibratory device in accordance with claim 2 wherein the rotation limiter of the bushing protrudes radially outward.

4. A vibratory device in accordance with claim 2 wherein the bushing can be circumferentially repositioned and locked to the shaft for rotation therewith.

5. A vibratory device in accordance with claim 4 wherein the bushing and the shaft each comprise a keyway and the vibratory device comprises a key positioned in the keyways.

6. A vibratory device in accordance with claim 1 wherein the vibratory device comprises a second eccentric weight that is connected to the first eccentric weight in a manner such that the second eccentric weight is rotationally driven via the first eccentric weight.

7. A vibratory device comprising a rotor and an eccentric weight, the rotor having a shaft, the shaft having a shaft axis about which the rotor is configured to rotate, the eccentric weight being mounted to the shaft and having a center of mass that is offset from the shaft axis, the vibratory device being configured such that the eccentric weight is in a first rotational orientation relative to the shaft and rotates with the shaft when the shaft rotates in a first direction about the shaft axis and such that the eccentric weight is in a second rotational orientation relative to the shaft when the shaft rotates in an opposite second direction about the shaft axis, the vibratory device being further configured such that the eccentric weight automatically transitions from the first rotational orientation to the second rotational orientation when the shaft is switched from rotating in the first direction to rotating in the second direction, the vibratory device being still further configured such that the vibratory device generates an oscillating load when the shaft rotates in the first direction at a speed and generates that same oscillating load when the shaft rotates in the second direction at that same speed.

8. A vibratory device in accordance with claim 7 wherein the rotor comprises bushing and the first eccentric weight is mounted on the bushing and can pivot relative to the bushing about the shaft axis only a limited amount.

9. A vibratory device in accordance with claim 8 wherein the bushing can be circumferentially repositioned and locked to the shaft for rotation therewith.

10. A vibratory device in accordance with claim 9 wherein the bushing and the shaft each comprise a keyway and the vibratory device comprises a key positioned in the keyways.

11. A vibratory device in accordance with claim 7 wherein the vibratory device comprises a second eccentric weight that is connected to the first eccentric weight in a manner such that the second eccentric weight is rotationally driven via the first eccentric weight.

12. A method of adjusting a vibratory device, the vibratory device comprising a rotor and an eccentric weight, the rotor having a shaft, the shaft having a shaft axis about which the rotor is configured to rotate, the eccentric weight being mounted to the shaft and having a center of mass that is offset from the shaft axis, the vibratory device being configured such that the eccentric weight is in a first rotational orientation relative to the shaft and rotates with the shaft when the shaft rotates in a first direction about the shaft axis and such that the eccentric weight is in a second rotational orientation relative to the shaft when the shaft rotates in an opposite second direction about the shaft axis, the method comprising:

operating the vibratory device in a manner such that the first eccentric weight is in the first rotational orientation, the shaft is rotating in the first direction at a speed, and the vibratory device generates an oscillating load;

reversing the direction in which the shaft of the rotor and the eccentric weight rotate about the shaft axis in a manner causing the eccentric weight to move from the first rotational orientation to the second rotational orientation, the shaft to rotate in the second direction at the speed, and the vibratory device to generate the oscillating load.

13. A method in accordance with claim 12 wherein the rotor comprises bushing and the first eccentric weight is mounted on the bushing and can pivot relative to the bushing about the shaft axis only a limited amount.

14. A method in accordance with claim 13 wherein the bushing can be circumferentially repositioned and locked to the shaft for rotation therewith and the method further comprises circumferentially repositioning the bushing relative to the shaft about the shaft axis.

15. A method in accordance with claim 12 wherein the first rotational orientation is one-hundred and eighty degrees from the second rotational orientation.

* * * * *